US005384927A

United States Patent [19]

Mardero et al.

[11] Patent Number: 5,384,927

[45] Date of Patent: Jan. 31, 1995

[54] SECURITY RAIL ATTACHMENT FOR A BED

[75] Inventors: Steve Mardero; Raymond Fulford; Harry Van de Mosselaer, all of Winnipeg, Canada

[73] Assignee: Canadian Aging & Rehabilitation Product Development Corp., Winnipeg, Canada

[21] Appl. No.: 9,737

[22] Filed: Jan. 27, 1993

[51] Int. Cl.[6] ..... A47C 21/08

[52] U.S. Cl. ..... 5/662; 5/430; 248/418; 248/289.1; 403/108; 403/4; 403/379

[58] Field of Search ..... 5/662, 658, 503.1, 425, 5/428, 429, 430, 507.1; 248/289.1, 282, 283, 418, 415, 500, 231.7; 403/109, 377, 108, 4, 354, 379, 378

[56] References Cited

U.S. PATENT DOCUMENTS

| | | | |
|---|---|---|---|
| D. 199,957 | 1/1965 | Bertoldo | 5/662 |
| 1,215,403 | 2/1917 | Parker | 5/503.1 |
| 1,215,850 | 2/1917 | Potts . | |
| 1,797,847 | 3/1931 | Vandagriff . | |
| 2,193,647 | 3/1940 | Rush . | |
| 2,233,911 | 3/1941 | Carson | 248/231.7 |
| 2,488,316 | 11/1949 | Mosby | 248/289.1 |
| 2,981,959 | 5/1961 | Burnham | 5/503.1 |
| 3,077,613 | 2/1963 | Mayer . | |
| 3,286,283 | 11/1966 | Bertoldo . | |
| 3,423,057 | 1/1969 | Iverson | 248/283 |
| 3,863,282 | 2/1975 | Stillwell | 5/503.1 |
| 4,798,380 | 1/1989 | Manyk . | |
| 4,932,090 | 6/1990 | Johansson . | |

*Primary Examiner*—Flemming Saether

*Attorney, Agent, or Firm*—Adrian D. Battison; Stanley G. Ade; Murray E. Thrift

[57] ABSTRACT

A security rail attachment for a bed comprises a post with an adjustable foot at the lower end, a rail portion mounted within the post and rotatable about the vertical axis of the post and an attachment rail which extends across the end of the bed and includes clamping elements for clamping to angle irons along the sides of the bed. The rotatable rail portion can be latched at four 90° spaced positions by notches in the base of a vertical post of the rail portion which cooperate with a transverse pin in the post. The rail portion can therefore project outwardly from the bed at right angles thereto for assisting the occupant in standing or can lie along the side of the bed to assist the occupant by preventing falling from that side of the bed.

16 Claims, 3 Drawing Sheets

SECURITY RAIL ATTACHMENT FOR A BED

BACKGROUND OF THE INVENTION

This invention relates to a security rail attachment for a bed of the type which can be used by elderly or infirm patients to assist in rising from the bed.

Many persons as they become older or become infirm have difficulty in alone entering and leaving the bed due to difficulties in moving from the sitting to the standing position and vice versa. Devices have been previously proposed for attachment to a bed to provide a rail adjacent the side of the bed to assist the occupant. Examples are shown in various published brochures. However the previous designs are generally unsatisfactory for attachment to bed frame arrangements of the type readily available in U.S.A. and Canada and are generally unsatisfactory for providing a stable and readily adjustable support for the patient.

SUMMARY OF THE INVENTION

It is one object of the present invention, therefore, to provide an improved security rail attachment for a bed.

According to the invention, therefore there is provided a security rail for attachment to a bed comprising a vertical post having a foot at a lower end for resting on a ground surface adjacent the bed, an elongate attachment member connected to the post and extending therefrom substantially at right angles thereto, each end of the attachment member having mounted thereon a clamping bracket for clamped attachment to an angle iron forming a side rail of the bed and a rail member including a post portion and a rail portion extending outwardly from the post portion to one side thereof, the post portion being arranged for mounting in the post to be supported thereby in vertical orientation with the rail portion extending therefrom in substantially horizontal orientation, the post portion being rotatable about a vertical axis of the post to move the horizontal rail portion between a first position in which it lies along side the bed and a second position in which it extends outwardly from the bed at right angles to the adjacent side of the bed, and means for latching the post portion in said first and second positions.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
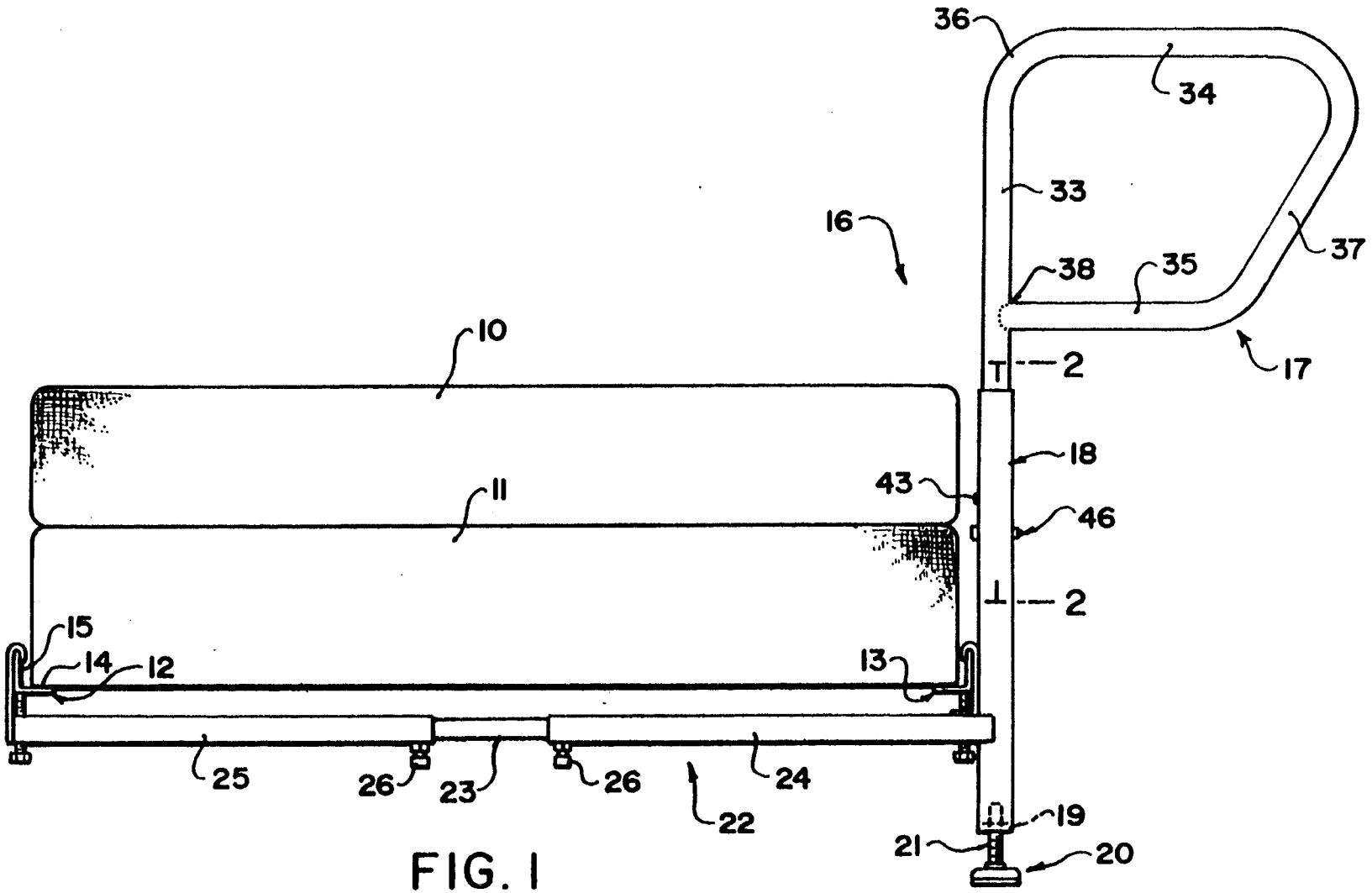
FIG. 1 is a front elevational view of a security rail attachment according to the present invention attached to a bed.

A conventional bed of the type generally used in North America comprises a mattress 10 mounted on a box spring 11 and carried upon an angle iron frame including side angle iron rails 12 and 13. The base frame includes the side rail 12 and 13 together with cross rails (not shown) and vertical legs which support the angle iron frame at a position a few inches above the ground. Each angle iron includes a horizontal flange 14 and a vertical flange 15 so that the box spring fits on the horizontal flange and is confined by the vertical flange.

The security rail attachment is generally indicated at 16 and is arranged for attachment to the bed frame and to provide a rail member 17 which the infirm occupant can hold while entering the bed and while lying or sitting in the bed.

Figure 2:
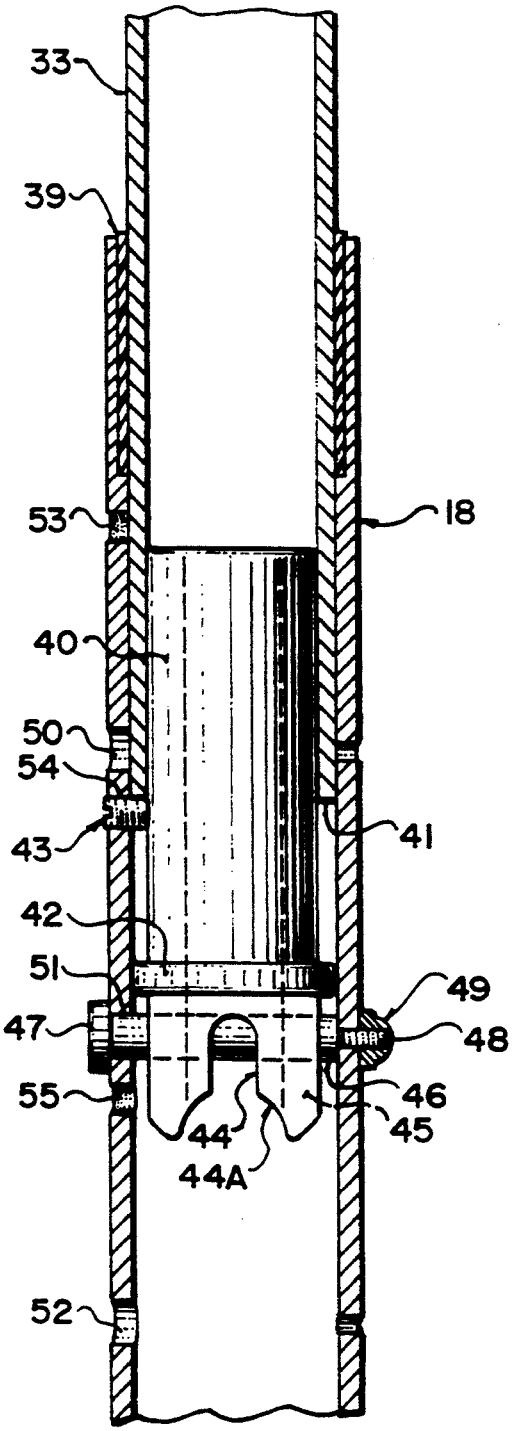
FIG. 2 is a cross sectional view taken at the lines 2—2.

The attachment comprises a post 18 which comprises a hollow tubular member best shown in FIG. 2, a lower end of which is closed by a transverse plate 19. The transverse plate 19 has a central threaded hole for receiving a shaft 21 of a foot 20 providing a foot pad for engaging the ground surface adjacent the side of the bed. The height of the foot pad can thus be adjusted by actuating the screw to raise and lower the foot pad relative to the end plate 19.

At a position spaced a few inches from the bottom end of the post is provided an attachment member 22 in the form of an elongate rail for extending across the underside of the bed. One end of the rail 22 is welded to the side of the post. The rail includes an adjustment portion 23 in the form of a tube of smaller cross section which can slide longitudinally of the first portion 24 of the rail and inside a second portion 25 of the rail to be fastened in place by screw clamps 26. The length of the rail 22 can therefore be adjusted by increasing or decreasing the amount of the central tube 23 which is exposed.

Figure 3:
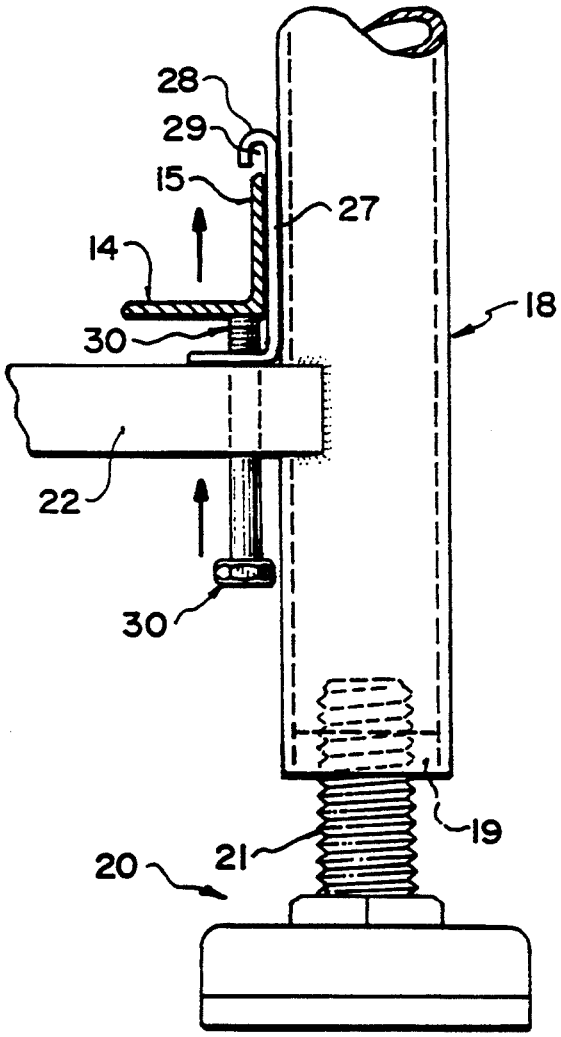
FIG. 3 is a view of the lower end of the post showing the attachment to the bed frame on an enlarged scale.

At each end of he attachment rail 22 is provided a clamping mechanism for clamping the side angle iron 12, 13 of the bed frame. The clamping mechanism is shown in enlarged scale in FIG. 3 and includes a vertical end plate 27 which lies alongside the flange 15. An upper edge of the plate 27 is turned over at 28 to define an inverted channel 29 for receiving a top edge of the vertical flange 15. The end of the rail 22 includes a vertical threaded hole through which a bolt 30 extends so as to clamp the horizontal flange 14 and to force that horizontal flange upwardly thus engaging the upper edge of the vertical flange 15 within the channel 29. The attachment can thus be mounted on the bed frame very simply by longitudinal adjustment of the length of the transverse rail 22 and by the clamping action of the clamping assemblies onto each of the angle irons of the side of the bed frame.

The rail portion 17 includes a vertical post portion 33, a first horizontal element 34, a second horizontal element 35 and curved into connecting portions 36 and 37. The horizontal element 34 and the post 33 are formed integrally by bending and similarly bends are formed to interconnect the horizontal elements 34 and 35. An innermost end of the element 35 is welded at 38 to the post portion at a position just above the top of the post 18. The rail element 17 is thus again formed from a tubular member so that the tubular portion of the post portion 33 is visible in FIG. 2. The diameter is selected that it is a sliding fit inside the post 18. To assist the sliding action, a plastics bearing collar 39 is provided on the inside surface of the post 18 at the top edge thereof and received within a rebated section inside the tubular post 18.

An end plug 40 is inserted into the end of the tubular post portion 33 and is fixed in place as a friction fit or by welding or other suitable technique so that its position is fixed relative to an end surface 41 of the post portion 33. The end plug is generally cylindrical in shape but includes an outwardly extending peripheral collar 42 surrounding the end plug at a position spaced from the end surface 41. This spacing provides a lost motion connection the limits of which are controlled by a set screw 43 projecting into the area between the collar 42 and the end surface 41.

Below the collar 42, the end plug is shaped to form two transverse notches 44 and 45. The notch 44 is visible in elevation in FIG. 2. The notch 45 is not directly visible but is shaped identically to the notch 44. The notches cooperate with a transverse pin 46 extending across and attached to the tubular post 18. The pin 46 thus includes an end head 47, a wider portion which extends across the full width of the tube as a cylindrical body across the tube 18 and a threaded narrower section 48 which projects through a smaller hole in the tube 18 and cooperates with an end nut 49 on the outside surface of the tube 18.

As illustrated in FIG. 2, therefore, the notch 45 is sitting astride the pin 46. The shape of the notch is such that it has a diameter at a base of the notch matching or equal to the diameter of the pin 46. The notch then includes vertical side walls which extend to a sufficient height to receive and contain the pin within the notch. Beyond the vertical side walls the side walls diverge outwardly to provide a mouth 44A for guiding the pin into the notch. The shape of the mouth includes curved surfaces which diverge outwardly from the end of the U-shaped notch. This al lows the pin to be misaligned with the notch when the post portion is moved vertically downwardly and there thus a self-centering action.

Thus the post portion 33 can slide upwardly through the lost motion connection provided between the collar 42 and the surface 41 to a height sufficient to allow it to be rotated through 90° causing the notch 44 to be aligned with the pin 46 and the notch 45 turned to the position facing the reader in FIG. 2. In this position the post portion 33 can be lowered. The pin and the notches thus act as a latch arrangement to hold the post portion 33 at four positions arranged at 90° around the axis of the post 18, allowing the post portion thus to rotate through those four separate positions around the axis of the post 18. Thus the rail portion 17 can be adjusted from a first position shown in FIG. 1 in which it projects outwardly from the side of the bed at right angles thereto to a second position in which it lies alongside the bed projecting away from the bed head toward the foot of the bed. Two further positions are also possible in which the rail portion projects across the bed to assist the occupant to rise from a lying position to a seated position and also the rail portion can be moved to a position alongside the bed but facing the bed head.

In practice the attachment is mounted on the bed at a position approximating the waist of the occupant when lying so that the occupant can move to a seated position and then swivel about a vertical axis generally through the buttocks to move the legs out to the side of the bed. With the rail portion then projecting outwardly from the side of the bed, the person can stand with their hand resting upon the horizontal rail element 34 and can pull themselves forwardly to a full standing position.

The height of the rail element 34 can be adjusted to one of three selected positions by placing the pin 46 through aligned holes 50, 51, or 52 with the end 48 of the pin projecting through an aligned hole on the opposed side of the post. Similarly the set screw 43 can be located in selected ones of holes 53, 54 or 55.

Figure 4:
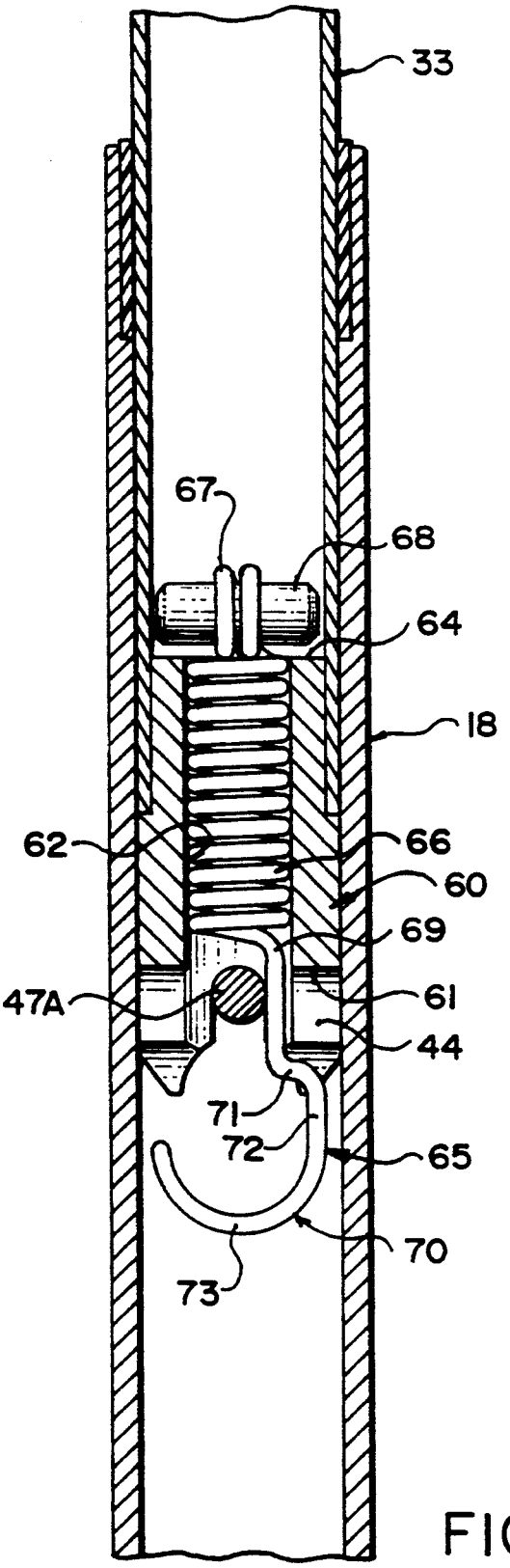
FIG. 4 is a cross sectional view similar to that of FIG. 2 showing a modified arrangement.
Figure 5:
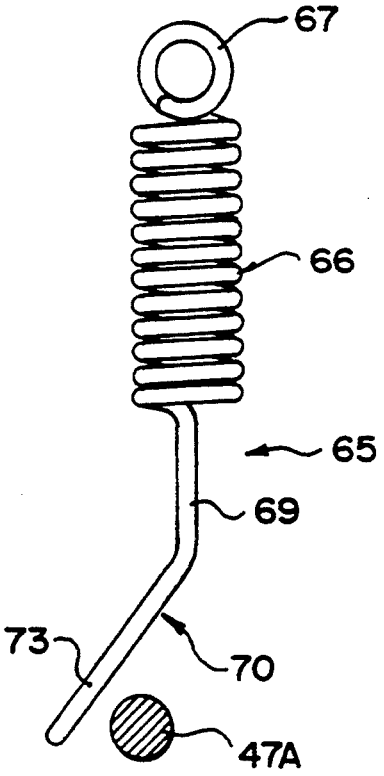
FIG. 5 is a cross sectional view taken along the lines 5—5 of FIG. 4 and showing only the latching spring.

Turning now to FIGS. 4 and 5 there is shown an alternative arrangement of the latching system for the post portion 33 within the post 18. At the base of the post member 33 is inserted a plug 60 which is inserted into the end of the post portion so as to form a lower end face 61 of the post portion. The plug 60 includes a hollow central bore 62 along the full length of the plug breaking out at an upper end face 64 and extending through the lower end surface 61 at which the transverse notches 44 are defined as previously set forth.

Within the bore 62 is provided a spring 65. The spring 65 includes a coil portion 66 which has an outside diameter substantially equal to the inside diameter of the bore 62 so as to fit as a sliding fit therein. At the top end of the coil portion 66 is defined a loop 67 through which is inserted a pin 68 extending across the inside surface of the post portion and able to engage the upper surface 64 of the plug 60. At the lower end of the coil portion 66 is defined a spring leg 69 which extends longitudinally of the bore to the lower end of the bore. At the end of the leg portion 69 is provided a counted loop 70. The loop 70 includes a first portion 71 turned at right angles to the leg 69 followed by a second portion longitudinal of the post as indicated at 72. At the end of the portion 72 is formed a U-shaped section 73 which, as best shown in FIG. 5 is inclined at an angle of the order of 45° to the longitudinal direction of the post with the U-shape lying in a common inclined plane.

The lower surface 61 including the notches 44 cooperates with the pin indicated at 47A. In this arrangement the pin is a simple pin with a handle at one end which can be inserted through two common holes aligned diametrically of the post as a simple sliding fit, the pin remaining in place by the frictional engagement of the pin with the notch.

As shown in FIG. 4, when inserted into place, the U-shaped hook portion 73 engages under the pin to limit the amount of upward movement which is allowed of the post portion relative to the post. When the pin 47A is however removed, the post portion can be lifted clear from the post. When the pin is reinserted into a second opening at a different height in the post, the post portion can be reinserted into the post and the angle of the loop portion of the spring will cause it to engage the pin as shown in FIG. 5 and to be turned by the engagement with the pin to take up the position shown in FIG. 4. Thus, regardless of the orientation of the post portion when it is inserted, the spring is turned inside the plug to take up the required orientation to hold the post portion in place.

Since various modifications can be made in my invention is hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A combination of bed and a security rail for attachment to the bed the bed comprising a bed frame having side rails defined by a pair of angle irons each having a vertical flange and a horizontal flange, the security rail comprising a vertical post having a foot at a lower end for resting on a ground surface adjacent the bed frame, an elongate attachment member connected to the post and extending therefrom substantially at right angle thereto, each end of the attachment member having mounted thereon a respective one of a pair of clamping brackets each for clamped attachment to a respective one of said angle irons, a rail member including a post portion and a rail portion extending outwardly from the post portion to one side thereof, the post portion being arranged for mounting in the post to be supported thereby in vertical orientation with the rail portion extending therefrom in substantially horizontal orientation, the post portion being rotatable about a vertical axis of the post to move the horizontal rail portion between a first position in which it extends outwardly from the bed at right angle to the adjacent side of the bed and a second position in which it extends parallel to the adjacent side of the bed, and latching means for latching the post portion in said first and second positions, said latching means comprising a horizontal pin, means mounting the pin in the post and arranged for location of the pin at different height within the post, a lowermost surface of the post portion which is arranged for cooperation with the pin, the lowermost surface having two horizontal transverse notches thereacross arranged mutually at right angles such that a selected one of the notches can be engaged on the pin by downward vertical movement of the post portion, and means for limiting upward movement of the post portion relative to the post, the distance of upward movement being sufficient to allow release of the pin from the notches, each notch being shaped in cross-section to define a first U shaped portion having parallel sides shaped to engage over and receive the pin therein and a second mouth portion having diverging sides communicating with said parallel sides such that the mouth portion guides the pin into the notch to cause movement of the post portion to the required orientation.

2. The combination according to claim 1 wherein each clamping bracket comprises an upstanding support plate fixedly attached to the attachment member and upstanding therefrom, an upper edge of the support plate being turned downwardly to define inverted channel between the support plate and the upper edge for receiving an upper edge of the vertical flange of the angle iron therein and a clamping screw passing through the attachment member in screw threaded engagement therewith such that rotation of the screw causes an upper end thereof to move vertically relative to the support plate toward said channel, said upper end being in engagement with an underside of said horizontal flange of the angle iron to force the vertical flange into said channel.

3. The combination according to claim 1 wherein the elongate attachment member is adjustable so as to accommodate different widths of bed.

4. The combination according to claim 1 including means for adjusting the position of the foot vertically relative to the post.

5. The combination according to claim 1 including means for adjusting the height of the post portion relative to the post.

6. The combination according to claim 1 wherein the rail portion includes an upper rail element integrally formed with the post and connected thereto by a curved interconnection portion and a second rail element underlying the first rail element and connected thereto by a curved interconnecting portion, an end of the second rail element being connected to the post portion at a position thereon below the top of the post.

7. A combination of bed and a security rail for attachment to the bed the bed comprising a bed frame having side rails defined by a pair of angle irons each having a vertical flange and a horizontal flange, the security rail comprising a vertical post having a foot at a lower end for resting on a ground surface adjacent the bed frame, an elongate attachment member connected to the post and extending therefrom substantially at right angle thereto, each end of the attachment member having mounted thereon a respective one of a pair of clamping brackets each for clamped attachment to a respective one of said angle irons, a rail member including a post portion and a rail portion extending outwardly from the post portion to one side thereof, the post portion being arranged for mounting in the post to be supported thereby in vertical orientation with the rail portion extending therefrom in substantially horizontal orientation, the post portion being rotatable about a vertical axis of the post to move the horizontal rail portion between a first position in which it extends outwardly from the bed at a right angle to the adjacent side of the bed and a second position in which it extends parallel to the adjacent side of the bed, and latching means for latching the post portion in said first and second positions, said latching means comprising a horizontal pin, means mounting the pin in the post and arranged for location of the pin at different height within the post, a lowermost surface of the post portion which is arranged for cooperation with the pin, the lowermost surface having two horizontal transverse notches thereacross arranged mutually at right angles such that a selected one of the notches can be engaged on the pin by downward vertical movement of the post portion, and means for limiting upward movement of the post portion relative to the post, the distance of upward movement being sufficient to allow release of the pin from the notches, each notch being shaped in cross section to define a first U-shaped portion having parallel sides shaped to engage over and receive the pin therein and a second mouth portion having diverging sides communicating with said parallel sides such that the mouth portion guides the pin into the notch to cause movement of the post portion to the required orientation, said means for limiting upward movement comprising a spring hook member engageable under the pin, the spring hook member being shaped so as to deflectable to pass over the pin when inserted into the post.

8. The combination according to claim 7 wherein the spring hook member includes a leg portion and a U-shaped hook portion and is rotatable relative to the post portion, the U-shaped hook portion being shaped so as to be rotated by contact with the pin to a position in which the U shaped hook portion thereof lies transverse to the pin and engages under the pin in a hooking action.

9. The combination according to claim 8 wherein the spring hook member includes a helical coil portion having an axis extending longitudinally of the post portion.

10. The combination according to claim 9 wherein the post portion includes an end plug member having a central bore extending longitudinally of the post portion and wherein the helical coil portion is received with in the bore.

11. The combination according to claim 8 wherein the U-shaped hook portion is arranged at a lower end of the leg portion and lies in a plane inclined to the leg portion.

12. The combination according to claim 7 wherein each clamping bracket comprises an upstanding support plate fixedly attached to the attachment member and upstanding therefrom, an upper edge of the support plate being turned downwardly to define inverted channel between the support plate and the upper edge for receiving an upper edge of the vertical flange of the angle iron therein and a clamping screw passing through the attachment member in screw threaded engagement therewith such that rotation of the screw causes an upper end thereof to move vertically relative to the support plate toward said channel, said upper end being in engagement with an underside of said horizontal flange of the angle iron to force the vertical flange into said channel.

13. The combination according to claim 7 wherein the elongate attachment member is adjustable so as to accommodate different widths of bed.

14. The combination according to claim 7 including means for adjusting the position of the foot vertically relative to the post.

15. The combination according to claim 7 including means for adjusting the height of the post portion relative to the post.

16. The combination according to claim 7 wherein the rail portion includes an upper rail element integrally formed with the post and connected thereto by a curved interconnection portion and a second rail element underlying the first rail element and connected thereto by a curved interconnecting portion, an end of the second rail element being connected to the post portion at a position thereon below the top of the post.

* * * * *